US006111457A

United States Patent [19]

Lim et al.

[11] Patent Number: 6,111,457

[45] Date of Patent: Aug. 29, 2000

[54] INTERNAL POWER SUPPLY CIRCUIT FOR USE IN A SEMICONDUCTOR DEVICE

[75] Inventors: Jong-Hyoung Lim; Sang-Seok Kang; Jae-Hoon Joo; Chang-Joo Choi, all of Kyunggi-do, Rep. of Korea

[73] Assignee: Samsung Electronics, Co., Ltd., Suwon, Rep. of Korea

[21] Appl. No.: 09/044,382

[22] Filed: Mar. 18, 1998

[30] Foreign Application Priority Data

Mar. 18, 1997 [KR] Rep. of Korea ..... 97-9189

[51] Int. Cl.[7] ..... G05F 3/02

[52] U.S. Cl. ..... 327/541; 327/543

[58] Field of Search ..... 327/538, 540, 327/541, 543, 530, 72

[56] References Cited

U.S. PATENT DOCUMENTS 5,592,121 1/1997 Jung et al. ..... 327/541

5,821,808 10/1998 Fujima ..... 327/541

5,880,624 3/1999 Kayanagi et al. ..... 327/541

*Primary Examiner*—Jung Ho Kim

*Attorney, Agent, or Firm*—Marger Johnson & McCollom, P.C.

[57] ABSTRACT

An internal power supply circuit for use in a semiconductor device includes a clamp circuit for clamping an internal voltage to a constant level. The clamped internal voltage is distributed to internal circuits of the semiconductor device through an output node. When the internal voltage rises momentarily due to noise in the internal power supply circuit due to open-circuit phenomenon, the rising internal voltage is discharged through the clamp circuit, thereby maintaining the internal voltage at a constant value. The clamp circuit includes a first transistor for discharging the output node, and a diode-connected transistor for generating a charge voltage at the gate of the first transistor. The threshold voltage of the diode-connected transistor is preferably equal to or lower than the threshold voltage of the first transistor.

15 Claims, 5 Drawing Sheets

INTERNAL POWER SUPPLY CIRCUIT FOR USE IN A SEMICONDUCTOR DEVICE

This application corresponds to Korean patent application No. 97-9189 filed Mar. 18, 1997 in the name of Samsung Electronics Co., Ltd.

BACKGROUND OF THE INVENTION

1. Field of the Invention

The present invention relates to an internal power supply circuit for use in a semiconductor device, and more particular y to an internal power supply circuit which maintains an internal power supply voltage at a constant level.

2. Description of the Related Art

High density semiconductor memory devices often require an internal supply voltage of, for example, about 3 volts, which must be kept constant regardless of the external power supply voltage, which can have an operational range of 3~6 volts.

As shown in FIG. 1, a conventional internal power supply circuit includes a comparator 20 and a driver 40. The comparator 20 compares the internal voltage VCCint with a reference voltage Vref and generates a comparison result signal S_COMP through an output node 2. The internal voltage VCCint is provided to the internal circuits of the semiconductor device through an output node 1 of the internal power supply circuit. The driver 40 is comprised of a P-channel transistor having a gate for receiving the comparison result signal S_COMP, drain connected with the output node 1, and a source for receiving a power source voltage VCCext (hereinafter, referred to as the "external voltage") which is applied externally through an input node 3.

If the reference voltage Vref is higher than the internal voltage VCCint, the signal S_COMP is kept at the ground voltage Vss until VCCint increases to the voltage Vref . The driver 40 is then activated to transfer charge from the input node 3 to the output node 1. This causes the internal voltage VCCint to increase to the reference voltage Vref, and then the comparison result signal switches to the external voltage level. The driver 40 is then deactivated.

However, in the conventional internal power supply circuit described above, the internal voltage VCCint may rise momentarily, as shown by graph "A" of FIG. 7, due to noise or a short-circuit between internal circuit lines which receive voltages that are relatively high with respect to the internal voltage. This causes serious problems such as increased power consumption and changes in operational characteristics of internal circuits, for example, the trip points of inverters change.

SUMMARY OF THE INVENTION

The present invention is intended to solve these problems.

It is an object of the present invention to provide an internal power supply circuit for use in a semiconductor device which can oromentarily clamp a rising internal voltage to a constant level.

According to one aspect of the present invention, an internal power supply circuit for use in semiconductor device comprises an output node for outputting an internal voltage; means for comparing the internal voltage with a reference voltage to generate a comparison signal; means for providing charge to the output node in response to the comparison signal; and means for discharging the output node when the internal voltage is higher than the reference voltage until the internal voltage is equal to the reference voltage.

As is apparent from the foregoing, even though the internal voltage rises momentarily during the operation thereof, the internal power supply circuit allows the internal voltage to be kept constant.

BRIEF DESCRIPTION OF THE DRAWINGS

This invention may be understood and its object will become apparent to those skilled in the art by reference to the accompanying drawings as follows.

DETAILED DESCRIPTION

Figure 2:
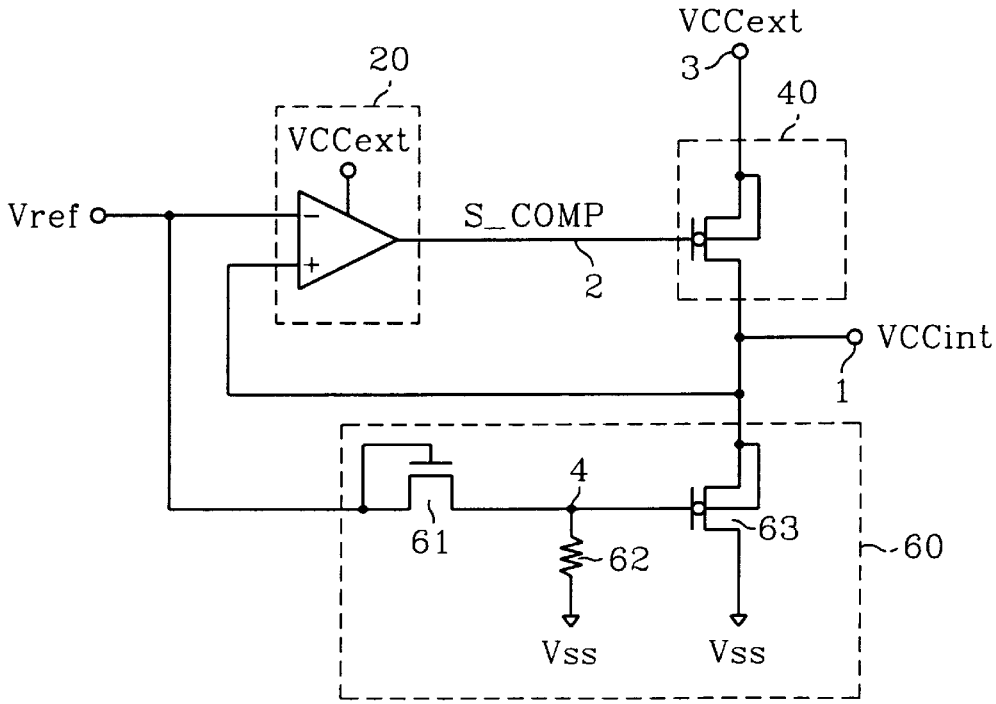
FIG. 2 is a circuit diagram showing a novel internal power supply circuit according to a first embodiment of the present invention.

Referring to FIG. 2, a novel internal power supply circuit for use in a semiconductor device in accordance with the present invention comprises a clamp circuit 60 in addition to a comparator 20 and a driver 40. The clamp circuit 60 is provided to clamp the internal voltage VCCint to a constant level and then deliver the clamped internal voltage through an output node 1 to internal circuits (not shown) of th e semiconductor device. When the internal voltage VCCint is momentarily rising due t the introduction of noise in the internal power supply circuit during a normal operation thereof, or due to an open-circuit phenomenon between internal circuit lines (not shown) which deliver relatively high voltages to the internal power supply circuit, the rising internal voltage VCCint is discharged through the clamp circuit portion 60, and thus, the inter al voltage is always kept at a constant level.

Figure 1:
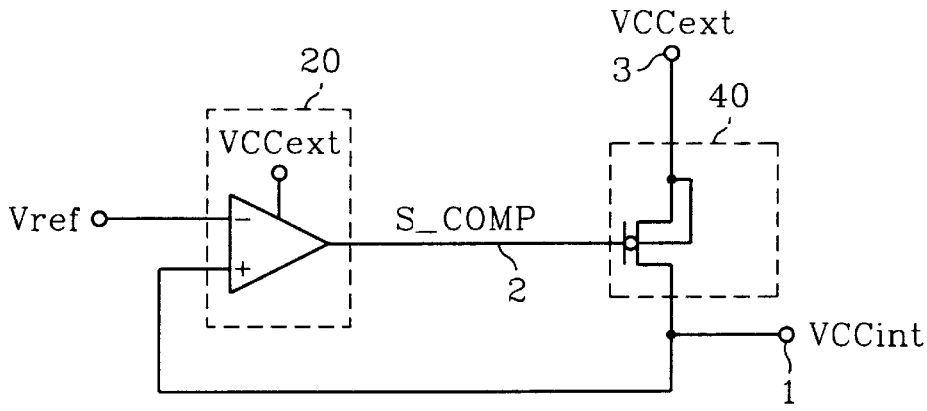
Fig. 1 (Prior Art)
FIG. 1 is a circuit diagram showing an example of an internal power supply circuit.

The comparator 20, which is similar construction to the comparator of FIG. 1, compares the internal voltage VCCint with he reference voltage Vref and provides a comparison result signal S_COMP through he output node 2 thereof. The internal voltage VCCint is provided to internal circuits of the semiconductor device through the output node 1 of the internal power supply circuit. The driver 40 consists of a P-channel transistor having a gate for receiving the comparison result signal S_COMP, a source for receiving an external voltage VCCext which is applied externally through an input node 3, and a drain connected to the output node 1.

If the internal voltage VCCint at the output node 1 is higher than the reference voltage Vref, the clamp circuit portion 60 discharge the output node 1 so that the voltage at the output node 1 is equal to the reference voltage Vref. As a result, the internal voltage VCCint is always kept constant.

An internal voltage supply circuit in accordance with the present invention can be formed on the same semiconductor device as the internal circuitry it supplies, or it can be fabricated separately.

First Embodiment

Referring again to FIG. 2, a first embodiment of an internal power supply circuit according to the present invention include a comparator 20, a driver 40 and a clamp circuit portion 60. The comparator 20 and the driver 40 operate in the same manner that those of FIG. 1, and thus, descriptions thereof are omitted.

Figure 7:
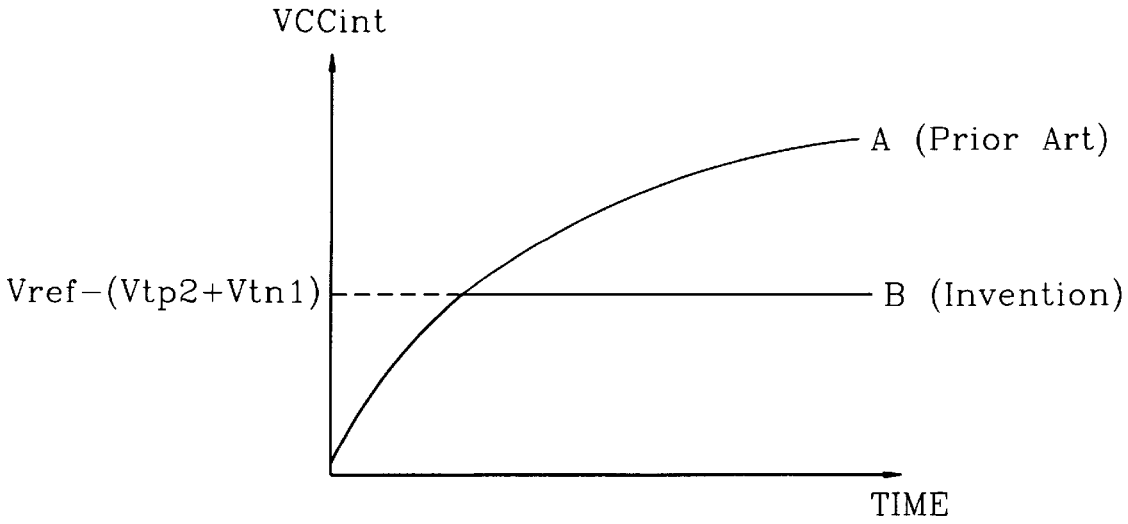
FIG. 7 is a graph showing output waveforms of the novel and the conventional internal power supply circuit.

The clamp circuit portion 60 includes an N-channel transistor 61, a resistor 62 and a P-channel transistor 63. The gate and drain of the N-channel transistor 61 are connected together and receive the reference voltage Vref. The source of transistor 61 is connected to a node 4. A resistor 62, which is connected between the node 4 and the ground node Vss, is provided to assure a charging voltage at node 4. The gate of the P-channel transistor 63 is connected to node 4, its source is connected to the output node 1, and its drain is connected to Vss. Since the N-channel transistor 61 controls the gate voltage of the P-channel transistor 63, the charging voltage at node 4 is always limited to a voltage level which subtracts the threshold voltage Vtnl of the N-channel transistor 61 from the reference voltage Vref. The threshold voltage of the P-channel transistor 63 is represented by Vtp2. When the internal voltage VCCint at the output node 1 is more than (Vref−Vtn1), the P-channel transistor 63 is turned on. Thus, even thou h the internal voltage VCCint is momentarily rising, it is clamped by the clamp circuit portion 60 to keep it at a constant voltage of {Vref−(Vtp2+Vtn1)} as shown by graph "B" of FIG. 7.

As can be seen from the foregoing, if the N-channel transistor 61 has a threshold voltage equal to or lower than the threshold voltage of the P-channel transistor 63, the internal voltage level VCCint at the output node 1 can be clamped to the reference voltage level-Vref. Ion implantation can be used to make an N-channel transistor 61 which has a threshold voltage that is lower than that of the P-channel transistor 63 so as to control the gate voltage of the P-channel transistor 63.

Figure 3:
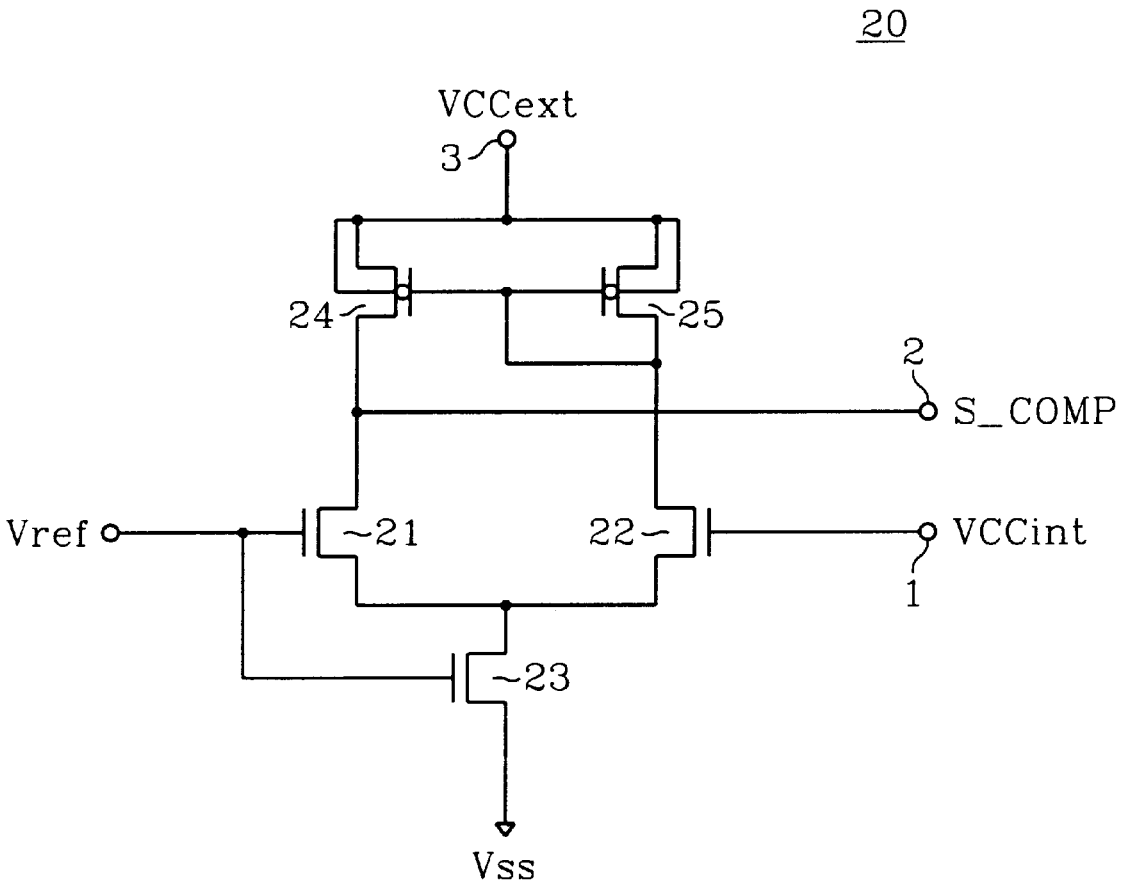
FIG. 3 is a detailed circuit diagram showing an example of a comparator shown in FIG. 2.
Figure 4:
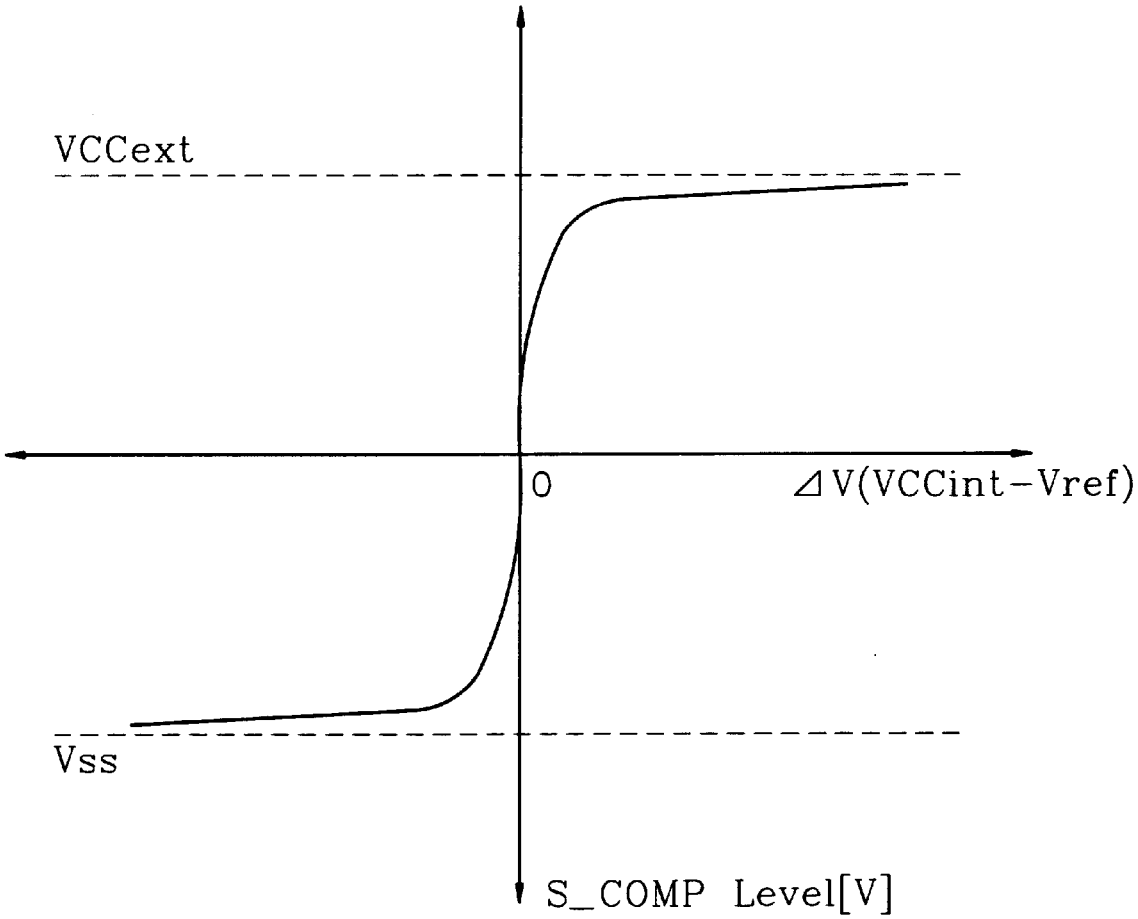
FIG. 4 is a graph showing an output waveform of the comparator shown in FIG. 2.

FIG. 3 shows an example of the comparator 20 shown in FIG. 2. The internal voltage provided from the output node 1 is supplied to the gate of an N-channel transistor 21, while the reference voltage Vref is supplied to the gate of an N-channel transistor 22. The sources of the transistors 21 and 22 are grounded through an N-channel transistor 23 which serves as a constant current source. The reference voltage Vref is also supplied to the gate of the transistor 23. The drain of transistor 51 is connected to the drain of a P-channel transistor 24, while the drain of transistor 22 is connected to the drain of P-channel transistor 25. Transistors 24 and 25 have their gates commonly connected to the drain of transistor 52, and the sources of transistors 54 and 55 are connected to the external voltage VCCext. The comparison result signal S_COMP, which has a waveform as shown in FIG. 4., output from the drain of transistor 21.

Second Embodiment

Figure 5:
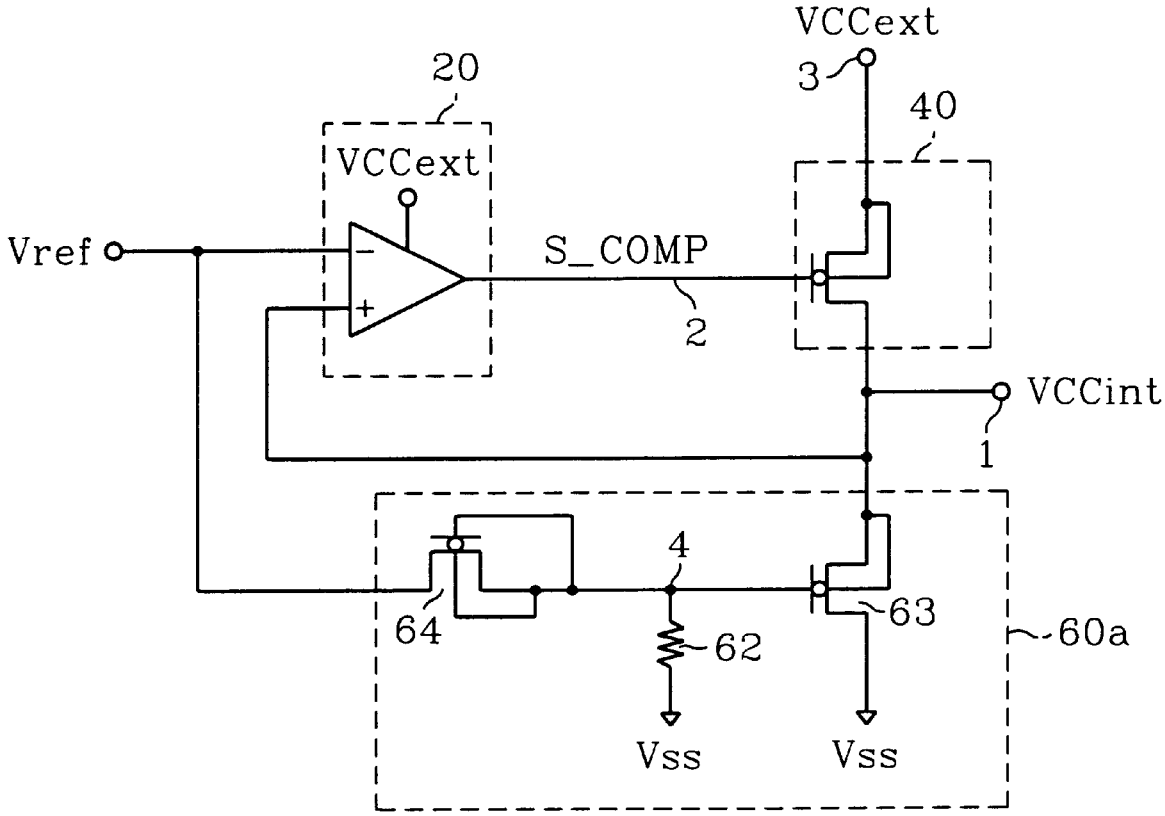
FIG. 5 is a circuit diagram showing an internal power supply circuit according to a second embodiment of the present invention.

FIG. 5 is a circuit diagram showing a second embodiment of an internal power supply circuit according the present invention. The internal power supply circuit of FIG. 5 is similar in construction to that of FIG. 2 (the first embodiment) except that a P-channel transistor is substituted for the N-channel transistor 61 Df the clamp circuit portion 60. In FIG. 5, components which are the same as those in FIG. 2 are indicated by the same reference numerals, and descriptions thereof are omitted.

The clamp circuit portion 60*a* includes a P-channel transistor 64, a resistor 62 and a P-channel transistor 63. The gate and drain of the P-channel transistor 64 are connected together and to the node 4, and the source thereof is connected to receive the reference voltage Vref. The resistor 62, which is connected between the node 4 and the ground Vss, is provided to assure a charging voltage at the node 4. The gate of the P-channel transistor 63 is connected to the node 4, the source thereof is connected to the output node 1, and the drain thereof is connected to the ground node V.

Since the P-channel transistor 64 controls the gate voltage of the P-channel transistor 63, the charging voltage at the node 4 is always limited to a voltage level which subtracts the threshold voltage Vtp1 of the P-channel transistor 64 from the reference voltage Vref. Assuming that the threshold voltage of the i-channel transistor 63 is represented by Vtp2, when the internal voltage VCCint at the output node 1 is more than (Vref−Vtp1), the P-channel transistor 63 is turned on. Thus, even though the internal voltage VCCint is momentarily rising, it is clamped by the clamp circuit portion 60*a* and kept to a constant voltage {Vref−(Vtp2+Vtp1)}.

Third Embodiment

Figure 6:
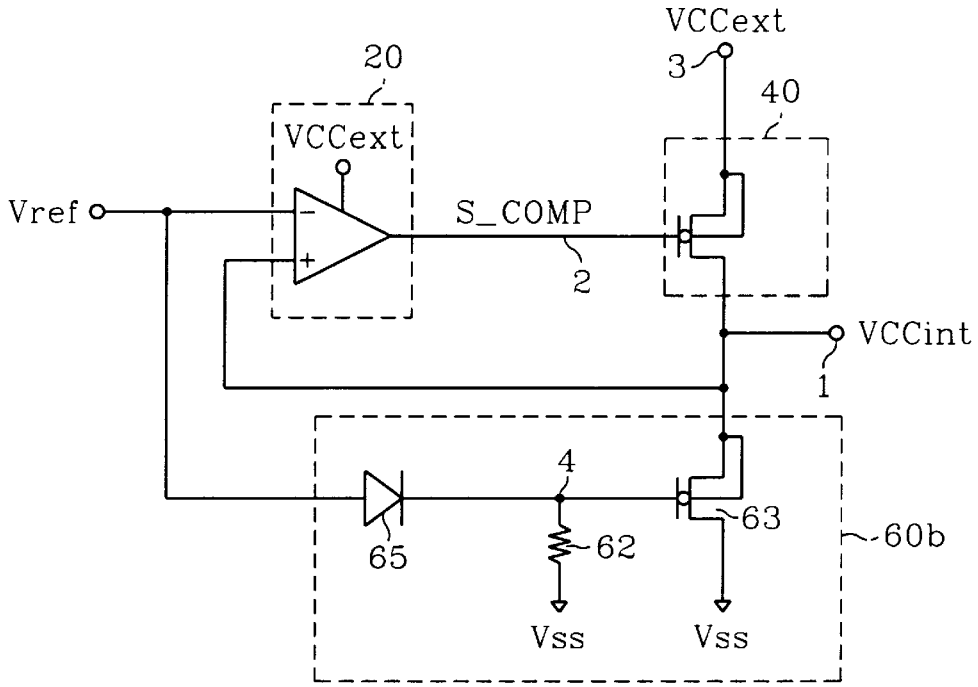
FIG. 6 is a circuit diagram showing an internal power supply circuit according to a third embodiment of the present invention.

FIG. 6 shows s third embodiment of an internal power supply circuit according to the present invention. The internal power supply circuit of FIG. 6 has the same construction as that of FIG. 2 (the first embodiment)except that a diode is substituted for the N-channel transistor 61 of the clamp circuit portion 60 In FIG. 6, components which are the same as those in FIG. 2 are indicated by the same reference numerals, and descriptions thereof are omitted.

The clamp circuit portion 60*b* includes a diode 65, a resistor 62 and a P-channel transistor 63. The anode of the diode 65 is connected to receive the reference voltage Vref, and the cathode thereof is connected to node 4. The resistor 62, which is connected between the node 4 and the ground node Vss is provided to assure a charging voltage at node 4. the gate of the P-channel transistor 63 is connected to node 4, its source thereof is connected to the output node 1, and its drain is connected to the ground node Vss.

Since the diode 65 controls the gate voltage of the P-channel transistor 63, the charging voltage at node 4 is always limited to a voltage level equal to the reference voltage Vref minus the threshold voltage Vdiode of the diode 65. The threshold voltage of the P-channel transistor 63 is represented by Vtp2. When the internal voltage VCCint at the output node 1 is more than (Vref−Vdiode), the P-channel transistor 63 is turned on. Thus, even though the internal voltage VCCint is momentarily rising, it is clamped by the clamp circuit portion 60*b* to a constant voltage of {Vref−Vtp2+Vdiode)}.

As described above, in an internal lower supply circuit according to the present invention, an output node is discharged through a clamp circuit until the output voltage is equal to a reference voltage, even though an internal voltage is momentarily rising. Accordingly, the internal power supply circuit allows the internal voltage to be clamped to constant voltage Also, the power consumption of the internal circuits of a semiconductor device to which the internal voltage is supplied is reduced since momentary increases in the internal voltage can be prevented.

What is claimed is:

1. An internal power supply circuit for use in a semiconductor device comprising:

an output node for outputting an internal voltage;

means for comparing the internal voltage with a reference voltage to generate a comparison signal;

means for providing charge to the output node in response to the comparison signal; and means for discharging the output node when the internal voltage is higher than the reference voltage until the internal voltage is substantially equal to the reference voltage;

wherein said means for discharging the output node comprises:

a first node;

an N-channel transistor having a drain for receiving the reference voltage, a gate connected to its drain, and a source connected to the first node;

a ground;

a resistor connected between the first node and the ground; and a first P-channel transistor having a source connected to the output node, a drain connected to the ground, and a gate connected to the first node.

2. The internal power supply circuit according to claim 1, wherein the threshold voltage of the N-channel transistor is equal to or lower than the threshold voltage of the first P-channel transistor.

3. An internal power supply circuit for use in a semiconductor device comprising:

an output node for outputting an internal voltage;

means for comparing the internal voltage with a reference voltage to generate a comparison signal;

means for providing charge to the output node in response to the comparison signal; and means for discharging the output node when the internal voltage is higher than the reference voltage until the internal voltage is substantially equal to the reference voltage;

wherein said means for discharging the output node comprises:

a node;

a first P-channel transistor having a source for receiving the reference voltage, a drain connected to the node, and a gate connected to its drain;

a resistor connected between the first node and a ground; and a second P-channel transistor having a source connected to the output node, a drain connected to the ground, and a gate connected to the drain of the first P-channel transistor.

4. The internal power supply circuit according to claim 3, wherein the threshold voltage of the first P-channel transistor is equal to or lower than the threshold voltage of the second P-channel transistor.

5. An internal power supply circuit for use in a semiconductor device comprising:

an output node for outputting an internal voltage;

means for comparing the internal voltage with a reference voltage to generate a comparison signal;

means for providing charge to the output node in response to the comparison signal; and means for discharging the output node when the internal voltage is higher than the reference voltage until the internal voltage is substantially equal to the reference voltage;

wherein said means for discharging the output node comprises:

a diode having an anode for receiving the reference voltage and a cathode connected to a first node;

a resistor connected between the first node and a ground; and a P-channel transistor having a source connected to the output node, a drain connected to the ground, and a gate connected to cathode of the diode.

6. The internal power supply circuit according to claim 5, wherein the threshold voltage of the diode is equal to or lower than the threshold voltage of the P-channel transistor.

7. The internal power supply circuit according to claim 5, wherein said means for comparing the internal voltage with the reference voltage comprises a differential amplifier.

8. A method for controlling an internal power supply voltage for a semiconductor device comprising:

comparing the internal power supply voltage to a reference voltage, thereby generating a comparison signal;

providing charge to an output node responsive to the comparison signal, thereby generating the internal power supply voltage at the output node;

discharging the output node with a transistor having a first threshold voltage when the internal power supply voltage exceeds the reference voltage;

generating a charging voltage at a first node which is equal to the reference voltage minus a second threshold voltage;

loading the first node through a resistor; and driving the transistor with the charging voltage.

9. The method of claim 8 wherein the second threshold voltage is less than the first threshold voltage.

10. The method of claim 8 wherein generating the charging voltage includes coupling a diode-connected transistor to a power supply terminal through the resistor.

11. The method of claim 8 wherein generating the charging voltage includes coupling a diode to a power supply terminal through the resistor.

12. An internal power supply circuit for use in a semiconductor device comprising:

a driver for supplying charge to an output node responsive to a comparison signal, thereby generating an internal voltage at the output node;

a comparator having a first input terminal coupled to the output node, a second input terminal coupled to receive a reference signal, and an output terminal coupled to the driver, wherein the comparator generates the comparison signal responsive to the reference signal and the internal voltage;

a first node;

a resistor coupled between the first node and a power supply terminal;

a first device coupled between the output node and the first node for discharging the output node, the first device having a first threshold voltage; and a second device coupled between the second input terminal of the comparator and the first node, the second device having a second threshold voltage.

13. The circuit of claim 12 wherein the first device is a transistor having a first terminal coupled to the first node, a second terminal coupled to the output node, and a third terminal coupled to a power supply terminal.

14. The circuit of claim 13 wherein the second device is a diode-connected transistor.

15. The circuit of claim 13 wherein the second threshold voltage is less than the first threshold voltage.

* * * * *

UNITED STATES PATENT AND TRADEMARK OFFICE

CERTIFICATE OF CORRECTION

PATENT NO. : 6,111,457
DATED : August 29, 2000
INVENTOR(S) : Lim et al.

It is certified that error appears in the above-identified patent and that said Letters Patent is hereby corrected as shown below:

Column 1,
Line 56, "oromentarily" should read -- momentarily --

Column 2,
Line 46, "inter al" should read -- internal --

Column 3,
Line 21, "Vtnl" should read -- Vtn1 --
Line 63, "Df" should read -- of --

Column 4,
Line 8, "V" should read -- Vss --
Line 14, "i-channel" should read -- p-channel --

Signed and Sealed this

Twelfth Day of March, 2002

*Attest:*

*Attesting Officer*

JAMES E. ROGAN
*Director of the United States Patent and Trademark Office*